US005488208A

United States Patent [19]

Seewald

[11] Patent Number: 5,488,208

[45] Date of Patent: Jan. 30, 1996

[54] MULTIPLE ELECTRICAL OUTLET BOX WITH LOCKING COVER AND POWER INTERRUPT SWITCH

[76] Inventor: Gerhard Seewald, Moosaecker 14, Eckental, Germany

[21] Appl. No.: 310,563

[22] Filed: Sep. 23, 1994

[30] Foreign Application Priority Data

Oct. 5, 1993 [DE] Germany ..... 9315054 U

[51] Int. Cl.[6] ..... H01H 9/28

[52] U.S. Cl. ..... 200/43.22; 200/43.11; 200/43.01; 439/133; 439/135

[58] Field of Search ..... 200/43.22, 43.01, 200/43.02, 43.04, 43.08, 43.11; 439/133, 134, 135, 136, 137, 138, 139, 140, 141

[56] References Cited

U.S. PATENT DOCUMENTS 3,524,029 8/1970 Laff ..... 200/43.02

4,063,110 12/1977 Glick ..... 439/133

*Primary Examiner*—Henry J. Recla
*Assistant Examiner*—David J. Walczak

[57] ABSTRACT

A multiple electrical outlet box which prevents unauthorized use of connected electrical devices. The multiple electrical outlet box includes a cover which is used to enclose electrical plugs which are connected to multiple outlets, thereby preventing their removal. A lock assembly including an attached mechanical latch locks the cover over multiple electrical outlets in response to a key. An electrical switch is provided which disables power to all enclosed outlets in response to rotation of the key lock and therefore in response to the attached mechanical latch. The cover encloses plugs connected to electrical outlets and therefore secures them against removal. The electrical switch disables power to all enclosed electrical outlets and connected electrical plugs.

1 Claim, 3 Drawing Sheets

MULTIPLE ELECTRICAL OUTLET BOX WITH LOCKING COVER AND POWER INTERRUPT SWITCH

TECHNICAL FIELD OF THE INVENTION

The invention relates to a multiple electrical outlet box with an attached extension cord, particularly to a multiple electrical outlet box having means for disabling the outlets and connected electrical plugs when desired, in order to prevent their unauthorized use.

In the case of many types of electrical appliances and devices, such as video recorders, television sets, power tools and the like, it would be extremely desirable not only to have a convenient means for preventing unauthorized use of the device, for example, by children, but at the same time to have a device which provides for multiple electrical outlets with this disabling function. Many disabling devices have been proposed for use in association with electrical plugs to prevent unauthorized use of electrical devices. However, none of these prior art disabling devices have enjoyed a significant degree of commercial success since they have, in order to be implemented, required removal of existing electrical plugs from appliances or removal of electrical plugs from locked enclosures. These procedures may be perceived as impractical by many end users seeking a device which combines the advantages of a multiple electrical outlet box with a convenient means for disabling electrical devices connected to these outlets.

BACKGROUND ART

The prior art, U.S. Pat. No. 5,193,665, provided for an electric plug including a disabling mechanism wherein a single electric plug has a key cylinder lock therein which disables electrical power to a single permanently connected device.

The prior art, U.S. Pat. No. 4,782,971, provided for a lock box for preventing unauthorized use of electrical appliances wherein a locking box encloses a single electrical appliance plug and therefore prevents the appliance from being plugged into an electrical socket.

BRIEF SUMMARY OF THE INVENTION

The invention is directed to the provision of a multiple electrical outlet box which provides for a simple disabling means for multiple electrical outlets and connected electrical plugs.

According to an important feature of the invention, electrical plugs connected to disabling outlets are secured against removal and enclosed by means of a locking cover. Electrical power to all enclosed outlets on the multiple electrical outlet box is simultaneously interrupted by means of an internally mounted switch in response to the rotation of a key operated lock.

Thereby, the actuation of connected electrical devices is prevented. This feature is of particular advantage and is a distinct improvement over certain prior art devices, in that it provides for multiple electrical outlets and positively renders electrical devices as inoperable, when these devices are plugged into the covered, locked and disabled outlets.

BRIEF DESCRIPTION OF THE DRAWINGS

The features of the present invention will be best understood by reference to the following description taken in conjunction with the accompanying drawings in which.

DETAILED DESCRIPTION OF THE PREFERRED EMBODIMENTS

Figure 1:
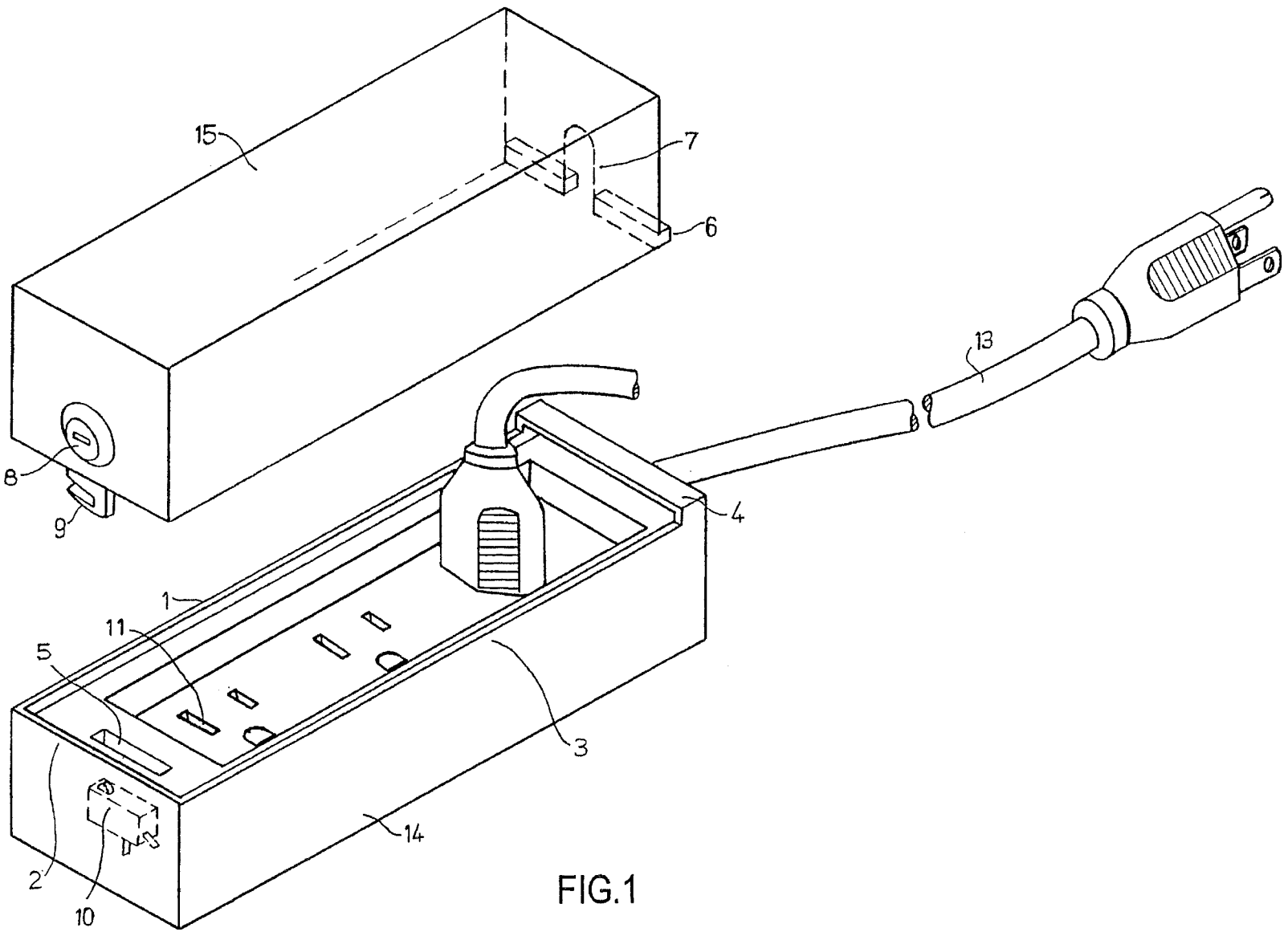
FIG. 1 is a perspective view of the multiple electrical outlet box with a removable locking cover.

Referring to FIG. 1 of the drawings, with the cover 15 removed, this multiple electrical outlet box 14 differs from a conventional multiple electrical outlet box in that it has an elevated outside edge on the sides 1, 2, and 3, and a slot on side 4 to engage the cover 15. On the opposite side of the multiple electrical outlet box 14, a small slot 5 is located, under which an electrical switch 10 is mounted.

The cover 15 includes on one end an extended lip 6 which is interrupted by a slot 7. Cables of devices with attached electrical plugs connected to outlets 11 are placed in such a way, so as to exit through this slot 7. The cover 15 is secured over the outlets 11 and over electrical plugs connected to outlets 11 initially by engaging the extended lip 6 in slot 4. The opposite end of the cover 15 engages in slot 5 by use of a downward motion axial to the outlet box 14, which subsequently encloses all electrical plugs connected in outlets 11.

Rotating the lock 8 with use of a key moves an attached mechanical latch 9 into a locking position within slot 5, and also activates an electrical switch 10 which disables to all enclosed outlets 11 the power sourced from cable 13. In this position, the key can be removed.

Should electrical devices connected to outlets 11 require activation, a key is used to rotate the lock 8 and an attached mechanical latch 9 in the opposite direction, which allows the electrical switch 10 to resume a closed position, thereby enabling electrical power to all outlets 11.

The cover 15 can permanently rest on the electrical outlet box 14. The elevated outside edges 1, 2, and 3 and the mechanical latch 9 which engages in slot 5 prevent removal and horizontal slippage of the cover 15 from the locked and secure position on the electrical outlet box 14.

Figure 3:
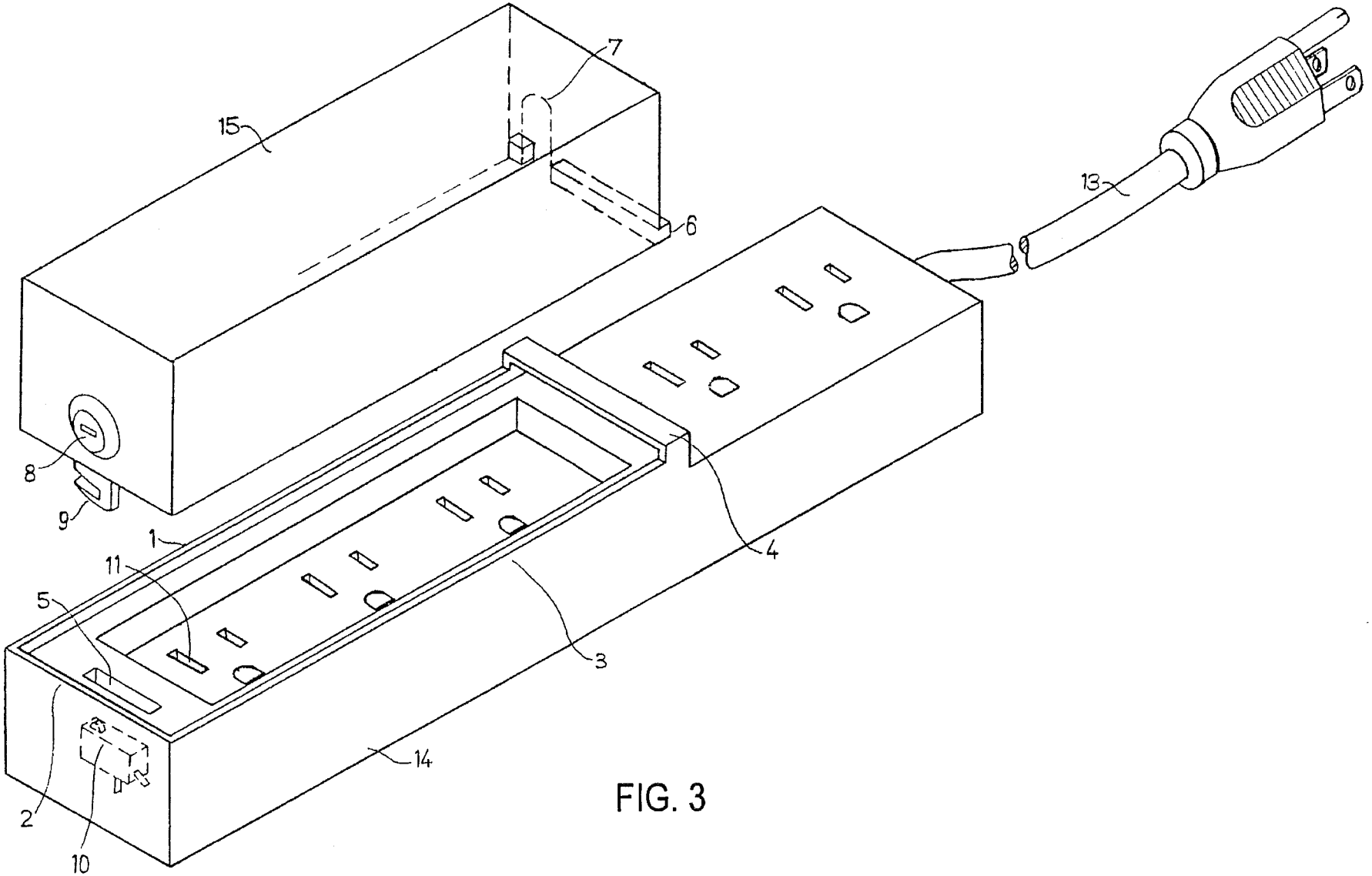
FIG. 3 is a perspective view of a version of the multiple electrical outlet box which combines covered, locked and disabled outlets with uncovered, uninterrupted electrical outlets on one and the same device.

The foregoing described functionality of this multiple electrical outlet box 14 and cover 15 is achievable utilizing designs pertaining to different versions of the invention, such as by a design that encloses and disables power to all outlets 11 as shown in FIG. 1, or by a design that combines enclosed and switched outlets with additional open, uncovered and uninterrupted outlets on one and the same device, as shown in FIG. 3, thereby providing different combinations of protected and unprotected outlets such as 1 of n, 2 of n, 3 of n, and so forth. An additional enhancement in functionality and versatility for the invented device may thereby be achieved.

Figure 2:
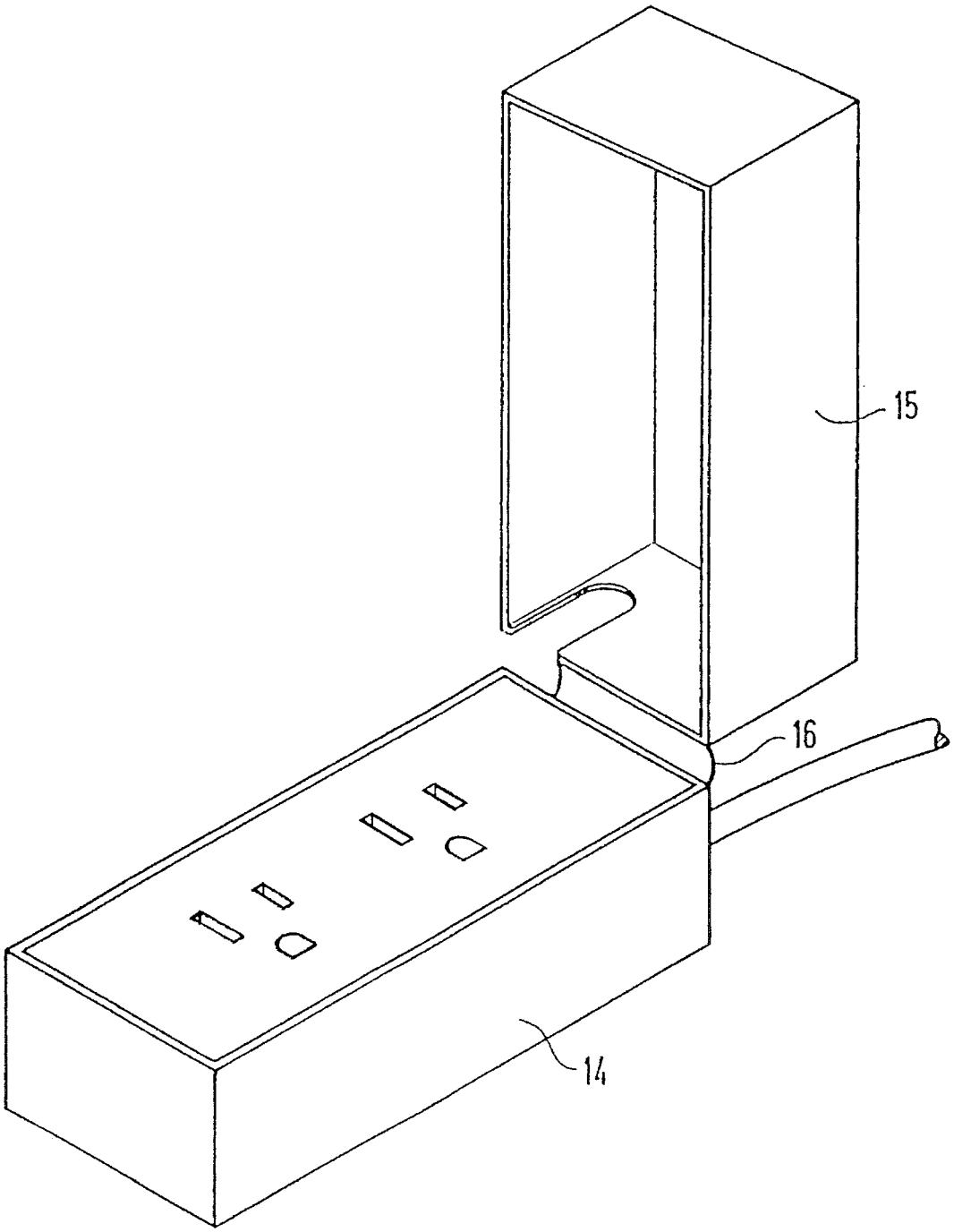
FIG. 2 is a perspective view of a version of the multiple electrical outlet box showing a hinged cover.

FIG. 2 shows a similar construction which uses a hinge 16 to connect the cover 15.

Whereas preferred embodiments of the invention have been illustrated and described in detail, it will be apparent that various changes may be made in the disclosed embodiments without departing from the scope or spirit of the invention. Therefore, the invention is not to be limited to the details given herein, but may be modified within the scope of the appended claims.

What is claimed is:

1. A multiple electrical outlet box having multiple outlets and an attached power cable for supplying power to said outlets, wherein at least one electrical plug adapted to be connected to one of said outlets is secured against removal from said electrical outlet box by a locking cover positioned on said outlet box and which encloses said multiple outlets and said plug when said plug is attached to one of said outlets, said cover including a keylock wherein a key for activating said keylock moves a mechanical latch in a locking position to thereby lock said cover to said outlet box and also disables an electrical switch wherein said switch enables electric power from the power cable to reach said outlets when said switch is enabled and prevents power from said power cable from reaaching said outlets when said switch is disabled and whereby at least one of said outlets is not covered by said cover when said cover is locked to said outlet box.

* * * * *